US008387208B2

(12) United States Patent
Davis

(10) Patent No.: US 8,387,208 B2
(45) Date of Patent: Mar. 5, 2013

(54) CLEANING COMPUTER PERIPHERALS

(75) Inventor: Raymond E. Davis, Heath, TX (US)

(73) Assignee: ADCO Industries—Technologies, L.P., Dallas, TX (US)

( * ) Notice: Subject to any disclaimer, the term of this patent is extended or adjusted under 35 U.S.C. 154(b) by 0 days.

(21) Appl. No.: 13/206,676

(22) Filed: Aug. 10, 2011

(65) Prior Publication Data

US 2012/0198651 A1 Aug. 9, 2012

Related U.S. Application Data

(60) Provisional application No. 61/441,171, filed on Feb. 9, 2011.

(51) Int. Cl.
*A47L 9/06* (2006.01)

(52) U.S. Cl. ..... 15/415.1; 15/398

(58) Field of Classification Search ..... 15/415.1, 15/396–400, 421, 114, 106, 393, 394
See application file for complete search history.

(56) References Cited

U.S. PATENT DOCUMENTS

| | | | | |
|---|---|---|---|---|
| 956,535 | A * | 5/1910 | Lotz | 15/399 |
| 1,597,855 | A * | 8/1926 | Zahorsky | 15/400 |
| 2,866,221 | A * | 12/1958 | Warva | 15/397 |
| 3,965,527 | A * | 6/1976 | George | 15/396 |
| 4,864,677 | A | 9/1989 | Levy | |
| 5,345,651 | A | 9/1994 | Roberts | |
| 5,706,550 | A * | 1/1998 | Holsten et al. | 15/400 |
| 6,854,153 | B1 | 2/2005 | Mueller | |
| 2007/0056138 | A1* | 3/2007 | Baan et al. | 15/398 |

OTHER PUBLICATIONS

Mini Vacuum Cleaner USB Keyboard, http://bestvacuumforhardwoodfloors.co/blog/mini-vacuum-cleaner-usb-keyboard.html, Aug. 3, 2011 (6 pages).
Computer Keyboard Vacuum Cleaner, http://www.yourdropshipper.com/dropship-as-seen-on-tv/keyboard-vacuum.htm, Aug. 3, 2011, (3 pages).
Mini Keyboard Vacuum, http://www.gadgets-weblog.com/50226711/mini_keyboard_vacuum.php, Aug. 3, 2011, (4 pages).
USB Mini Keyboard Vacuum Cleaner for PC Computer Laptop, http://www.ebuyfromchina.com/usb-mini-keyboard-vacuum-cleaner-for-pc-computer-laptop, Aug. 3, 2011 (3 pages).

* cited by examiner

*Primary Examiner* — Dung Van Nguyen
(74) *Attorney, Agent, or Firm* — Fish & Richardson P.C.

(57) ABSTRACT

A keyboard cleaning apparatus includes: a conduit configured to receive an airflow; and a brush attached to the conduit and including a plurality of bristles arranged in a pattern proximate at least one orifice in the brush, the pattern of bristles defining a passageway in fluid communication with the orifice, the passageway including at least two open ends configured to receive at least a portion of a key of a keyboard.

29 Claims, 8 Drawing Sheets

CLEANING COMPUTER PERIPHERALS

CLAIM OF PRIORITY

This application claims priority under 35 U.S.C. §119(e) to U.S. Provisional Patent Application Ser. No. 61/441,171 filed on Feb. 9, 2011, entitled "CLEANING COMPUTER PERIPHERALS," the entire contents of which are hereby incorporated by reference.

TECHNICAL BACKGROUND

This disclosure relates to a cleaning computers and computer peripherals and, more particularly, to a keyboard cleaner including a keyboard brush.

BACKGROUND

Keyboards often serve as an input device for computer systems, and are usually incorporated in the user interface of computer programs. For example, users can communicate data or commands to a computer program by actuating the keyboard keys (e.g., by tapping, pressing, or otherwise contacting the keys). As a result of recurring contact with the user's fingertips, surfaces of the keyboard keys tend to accrue a coating of grease or oil. This thin coating often attracts dust and dirt particles circulating in the immediate area. Over time, these particulates accumulate on the surfaces of the keyboard keys and in the areas surrounding the keyboard keys. This accumulation may be augmented by users who eat and/or drink in the vicinity of the keyboard.

Conventional cleaners of keyboards and other computer peripherals often include the use of compressed air to blow the dust and dirt particles away from the devices. Such conventional methods, however, often do not address the problems of accumulation of such debris in a workspace, where users eat and/or drink. Further, compressed air canisters often utilize dangerous chemicals that can be abused through purposeful inhalation.

SUMMARY

In one general embodiment, a cleaning apparatus includes: a conduit including a low pressure region and configured to receive an airflow directed from a high pressure region towards the low pressure region; a frame attached to the conduit and including an orifice configured to direct the airflow to the conduit; and a plurality of bristles attached to the frame proximate the orifice and defining the high pressure region near the orifice. A first portion of the plurality of bristles is configured to contactingly engage a first oblique surface of a key of a keyboard and urge debris proximate the first oblique surface into the airflow. A second portion of the plurality of the bristles is configured to contactingly engage a second oblique surface of the key of the keyboard and urge debris proximate the second oblique surface into the airflow. At least some of the plurality bristles are configured to contactingly engage a floor of the keyboard and urge debris proximate the floor into the airflow.

In a first aspect according to the general embodiment, the plurality of bristles are arranged in substantially parallel rows adjacent perimeter sides of the frame.

In a second aspect according to any of the previous aspects, a vertex of the orifice is substantially coincident with a center of the frame.

In a third aspect according to any of the previous aspects, the plurality of bristles are arranged in a plurality of groups of bristles.

In a fourth aspect according to any of the previous aspects, a particular group of bristles includes a first set of bristles and a second set of bristles.

In a fifth aspect according to any of the previous aspects, the first set of bristles are a first length and the second set of bristles are a second length greater than the first length.

In a sixth aspect according to any of the previous aspects, the first set of bristles are attached to the frame closer to a lengthwise centerline of the frame relative to the second set of bristles.

In a seventh aspect according to any of the previous aspects, the second length is substantially equal to a distance between a floor of the keyboard and a top surface of the key.

In an eighth aspect according to any of the previous aspects, the bristles configured to contactingly engage a floor of the keyboard comprise tips operable to agitate debris proximate the floor.

In a ninth aspect according to any of the previous aspects, wherein the bristles configured to contactingly engage the first or second oblique surfaces comprise elongated stalks operable to agitate debris proximate the first or second oblique surfaces.

In a tenth aspect according to any of the previous aspects, the bristles comprise flexible bristles.

In an eleventh aspect according to any of the previous aspects, the frame includes a substantially rectangular perimeter.

In a twelfth aspect according to any of the previous aspects, lengths of the lengthwise sides of the frame are one of approximately 36 mm, approximately 54 mm, or approximately 72 mm.

In a thirteenth aspect according to any of the previous aspects, the frame and the plurality of bristles define a fluid pathway between a floor of the keyboard and the orifice in which the airflow is substantially constrained.

In a fourteenth aspect according to any of the previous aspects, the frame includes an articulated frame having a first frame section and a second frame section, the first frame section hingedly connected to the second frame section and configured to angularly displace apart from the second frame section.

In a fifteenth aspect according to any of the previous aspects, the first frame section is configured to angularly displace apart from the second frame section about an axis substantially parallel to the groups of bristles.

In a sixteenth aspect according to any of the previous aspects, the first frame section is configured to angularly displace apart from the second frame section about an axis substantially orthogonal to the plurality of bristles.

In another general embodiment, a cleaning system includes: a vacuum assembly configured to generate a low pressure region near an inlet of the vacuum assembly; and a brush assembly, including a conduit coupled to the inlet of the vacuum assembly and configured to receive an airflow directed from a high pressure region towards the low pressure region; a frame attached to the conduit and including an orifice configured to direct the airflow to the conduit; and a plurality of bristles attached to the frame proximate the orifice and defining the high pressure region near the orifice. A first portion of the plurality of bristles is configured to contactingly engage a first oblique surface of a key of a keyboard and urge debris proximate the first oblique surface into the airflow. A second portion of the plurality of the bristles is configured to contactingly engage a second oblique surface of the key of the keyboard and urge debris proximate the second oblique surface into the airflow. At least some of the bristles are configured to contactingly engage a floor of the keyboard and urge debris proximate the floor into the airflow.

In a first aspect according to this general embodiment, the plurality of bristles are arranged in substantially parallel rows adjacent perimeter sides of the frame.

In a second aspect according to any of the previous aspects, a vertex of the orifice is substantially coincident with a center of the frame.

In a third aspect according to any of the previous aspects, the plurality of bristles are arranged in a plurality of groups of bristles.

In a fourth aspect according to any of the previous aspects, a particular group of bristles includes a first set of bristles and a second set of bristles.

In a fifth aspect according to any of the previous aspects, the first set of bristles are a first length and the second set of bristles are a second length greater than the first length.

In a sixth aspect according to any of the previous aspects, the first set of bristles are attached to the frame closer to a lengthwise centerline of the frame relative to the second set of bristles.

In a seventh aspect according to any of the previous aspects, the second length is substantially equal to a distance between a floor of the keyboard and a top surface of the key.

In an eighth aspect according to any of the previous aspects, the bristles configured to contactingly engage a floor of the keyboard comprise tips operable to agitate debris proximate the floor.

In a ninth aspect according to any of the previous aspects, the bristles configured to contactingly engage the first or second oblique surfaces comprise elongated stalks operable to agitate debris proximate the first or second oblique surfaces.

In a tenth aspect according to any of the previous aspects, the bristles comprise flexible bristles.

In an eleventh aspect according to any of the previous aspects, the frame includes a substantially rectangular perimeter.

In a twelfth aspect according to any of the previous aspects, lengths of the lengthwise sides of the frame are one of approximately 36 mm, approximately 54 mm, or approximately 72 mm.

In a thirteenth aspect according to any of the previous aspects, the frame and the plurality of bristles define a fluid pathway between a floor of the keyboard and the orifice in which the airflow is substantially constrained.

In a fourteenth aspect according to any of the previous aspects, the frame includes an articulated frame having a first frame section and a second frame section, the first frame section hingedly connected to the second frame section and configured to angularly displace apart from the second frame section.

In a fifteenth aspect according to any of the previous aspects, the first frame section is configured to angularly displace apart from the second frame section about an axis substantially parallel to the plurality of bristles.

In a sixteenth aspect according to any of the previous aspects, the first frame section is configured to angularly displace apart from the second frame section about an axis substantially orthogonal to the plurality of bristles.

In a seventeenth aspect according to any of the previous aspects, the vacuum assembly includes a debris container configured to store the debris delivered to the vacuum assembly in the airflow through the conduit.

In another general embodiment, a keyboard cleaning apparatus includes: a conduit configured to receive an airflow; and a brush attached to the conduit and including a plurality of bristles arranged in a pattern proximate at least one orifice in the brush, the pattern of bristles defining a passageway in fluid communication with the orifice, the passageway including at least two open ends configured to receive at least a portion of a key of a keyboard.

In a first aspect according to this general embodiment, wherein the at least one orifice includes a plurality of orifices.

In a second aspect according to any of the previous aspects, the plurality of bristles includes a plurality of groups of bristles, at least one group of bristles surrounding a particular orifice of the plurality of orifices.

In a third aspect according to any of the previous aspects, a length of the at least one orifice is greater than the length of a single size keyboard key.

In a fourth aspect according to any of the previous aspects, the passageway is configured to receive a plurality of single size keyboard keys.

In a fifth aspect according to any of the previous aspects, the brush includes a frame carrying the plurality of bristles, the frame having a side surface which defines a slot for attaching the brush to the conduit.

In a sixth aspect according to any of the previous aspects, the plurality of bristles includes a first set of bristles and a second set of bristles, the first set of bristles having a greater height than the second set of bristles.

In a seventh aspect according to any of the previous aspects, the bristles are configured to contactingly engage with side surfaces of a keyboard key.

In an eighth aspect according to any of the previous aspects, the bristles extend from a surface of the brush and terminate in a tapered tip.

In a ninth aspect according to any of the previous aspects, the length of the bristles is sufficient to reach an area of the keyboard beneath a set of keyboard keys.

In a tenth aspect according to any of the previous aspects, the bristles have sufficient stiffness to agitate debris deposited on the keyboard.

Various embodiments of a cleaning device according to the present disclosure may include one or more of the following features. For example, in various embodiments, the cleaning device may be provided with a vented brush assembly configured to envelope multiple components of the computer peripheral (e.g., multiple keyboard keys) while providing substantially unrestricted air flow in and around a cleaning area, thus providing a relatively high capacity for removing dust and dirt. Further, in various embodiments, the cleaning device may be operable to agitate and/or loosen debris in crevices or grooves of computer peripherals (for example, in the areas between keyboard keys). As another example, the cleaning device may capture dust, human skin and hair particles, and other debris typically found on a surface of computers or other electronic devices, rather than merely blow such debris away from the devices during cleaning. Further, the cleaning device may remove debris from computer and other electronic peripherals without the use of compressed air.

These general and specific aspects may be implemented using a device, system or method, or any combinations of devices, systems, or methods. The details of one or more implementations are set forth in the accompanying drawings and the description below. Other features, objects, and advantages will be apparent from the description and drawings, and from the claims.

DETAILED DESCRIPTION

Figure 1:
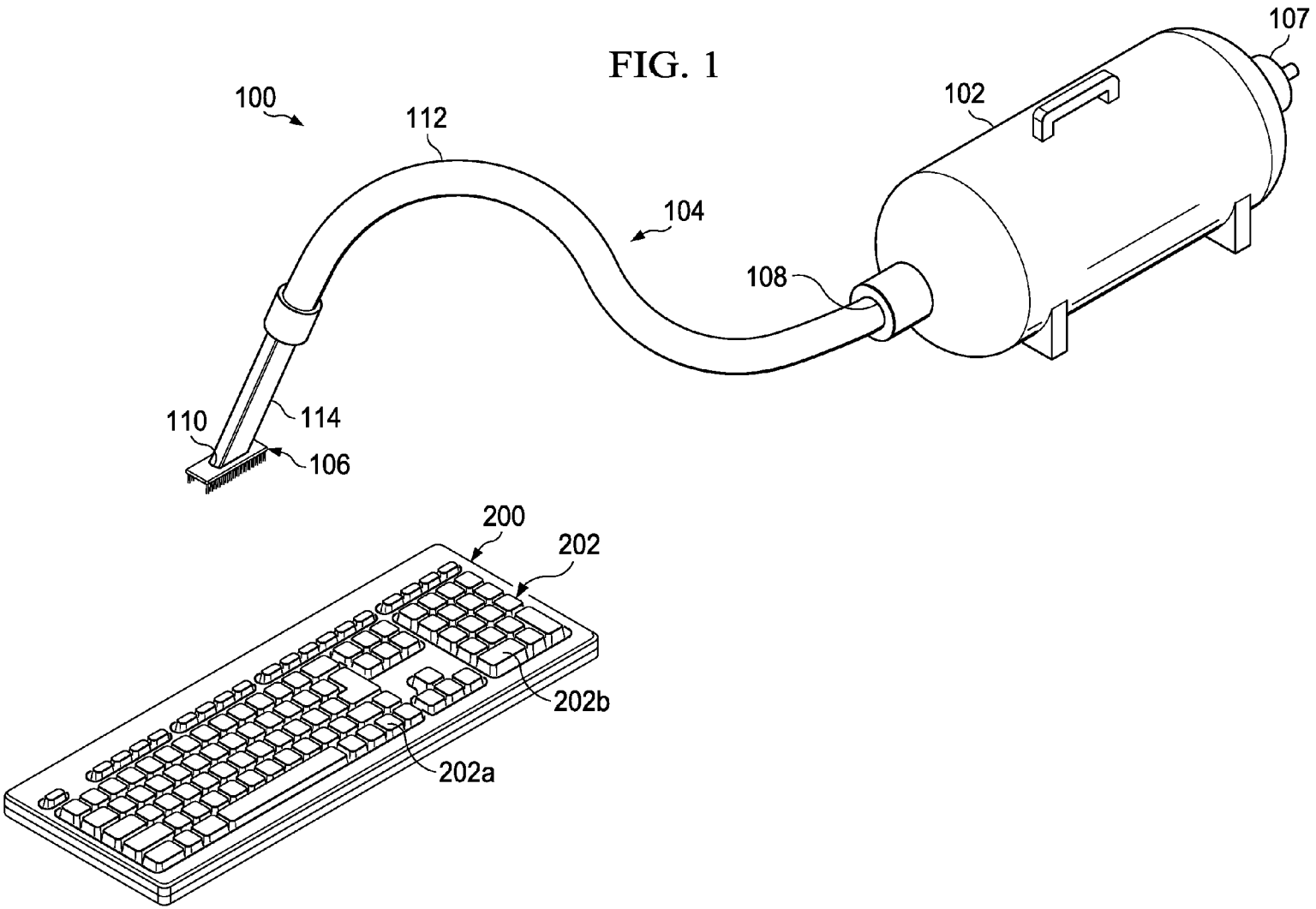
FIG. 1 illustrates one implementation of a computer peripheral cleaner in accordance with the present disclosure.
Figure 2:
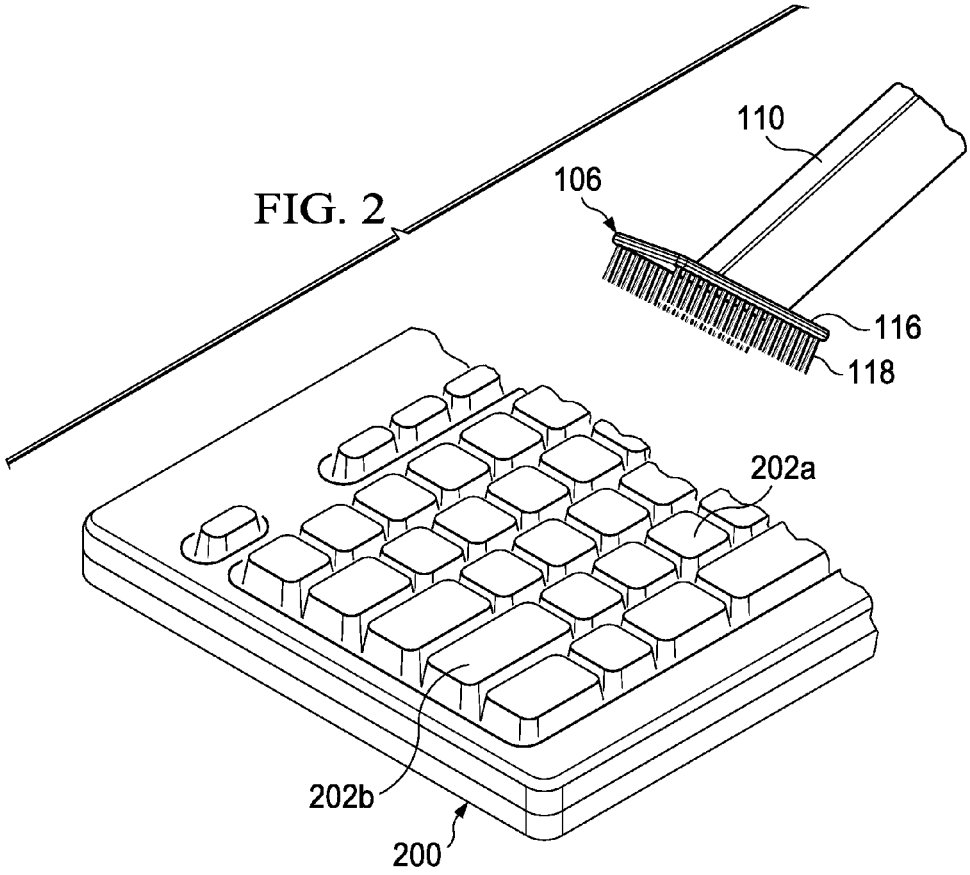
FIGS. 2-5 illustrate one implementation of a computer peripheral cleaner during use in accordance with the present disclosure.

FIG. 1 illustrates a peripheral cleaner 100 in accordance with the present disclosure. As shown, cleaner 100 includes a vacuum assembly 102, a conduit 104 coupled to the vacuum assembly 102, and a brush 106 coupled to the conduit 104. In certain other implementations, the brush 106 may be directly connected to the vacuum assembly 102 with no intervening conduit). In the illustrated embodiment, the cleaner 100 is configured to remove debris (e.g., human skin, dust, food crumbs, etc.) from the surfaces of a keyboard 200. More specifically, cleaner 100 may be configured to remove debris from the surfaces of keyboard keys 202 and a keyboard floor (keyboard keys 202 may be mounted on a supporting spring which floats on a rectangular funnel extending from the keyboard floor). Although keyboard 200 is illustrated in a standard form and layout, this disclosure is by no means limited to such arrangements. Peripheral cleaner 100 may be configured to remove debris from many different types of keyboards, both conventional and non-conventional types.

Vacuum assembly 102 (depicted schematically) is configured to provide the suction required to draw in debris deposited on the surfaces of keyboard 200. Vacuum assembly 102 can include any suitable configuration of hardware to provide the requisite suction for removing the debris from the keyboard 200. In this example, vacuum assembly 102 is provided in the form of a portable hand-held housing in which a releasable debris container and a motor driven blower (e.g., a 0.5 horsepower blower) are disposed. The blower forcibly draws in fluid (in this example, air) and loose debris carried by the fluid from keyboard 200 and into the debris container by creating a vacuum (or partial vacuum) within the housing (in some examples, the blower is provided with sufficient power to pull in a fluid at an appropriate velocity and/or volumetric flow rate). The fluid is then exhausted from the housing via an outlet 107 of the vacuum assembly 102. During use, the blower causes the pressure level within the housing to drop below the pressure level outside the housing. This pressure differential (i.e., pressure drop) motivates the ambient air surrounding the keyboard to flow into the housing and through the debris container while carrying loose debris from the keyboard surfaces. The debris remains stowed in the debris container (e.g., a removable bag or container) while the air is allowed to pass therethrough.

A first end 108 of conduit 104 is coupled to an inlet (not shown) of vacuum assembly 102. A second end 110 of the conduit is coupled to keyboard brush 106. The second end of the conduit 110 defines an orifice (e.g., orifice 120 shown in FIGS. 2-11) through which fluid is drawn by the vacuum assembly blower. The orifice may be provided with a sufficient open area to receive fluid and loose debris. It may be advantageous to provide the orifice with a large open area to enhance fluid flow. Enhanced fluid flow can increase the cleaning capacity of the keyboard cleaner 100 and inhibit damage to the vacuum motor. Further, the shape and size of the conduit orifice may be suitable for cooperating with a spine member of the keyboard brush 106. Conduit 104 can be provided in any suitable form. The conduit 104, however, may be suitable for constraining a flow of fluid carrying loose debris toward the debris container of vacuum assembly 102. In some implementations, the first end of the conduit 104 may be coupled to outlet 107 of the vacuum assembly. When coupled to the vacuum assembly outlet, fluid is blown from the orifice of conduit 104 and through the brush 106.

In some implementations, conduit 104 includes multiple segments. For instance, in this implementation, conduit 104 is provided with a first segment 112 having a tubular body composed of a flexible material and a second segment 114 that is composed of a rigid material. The first and second conduit segments 112, 114 may be fixedly or detachably coupled to one another. Further, in some examples, the first and second segments 112, 114 can be coupled to one another at an ergonomic angle (e.g., an angle between about 90-180 degrees).

Due to its flexibility, first conduit segment 112 may allow a user to manipulate the position of keyboard brush 106 without moving vacuum assembly 102. In contrast, second conduit segment 114 may provide a more rigid structure to allow the user to apply the keyboard brush 106 to a keyboard surface. That is, second conduit segment 114 may serve as a handle for keyboard brush 106. More specifically, in some examples, the second conduit segment 114 may be provided with one or more curved surfaces to facilitate handling of the keyboard brush 106 by a user. In certain other examples, the second conduit segment 114 may be provided with a handle extending from the fluid constraining portion of the segment. The handle can be either rotatably or fixedly coupled to the fluid constraining portion.

FIGS. 2-5 illustrate a keyboard brush **106*a* being applied to a keyboard 200. Keyboard brush 106*a* is coupled to second conduit end 110. The keyboard brush 106*a* may be fixedly or detachably coupled to the second conduit end 110. In certain implementations, keyboard brush 106*a* is rotatably coupled to second conduit end 110 such that the keyboard brush 106*a* is allowed to swivel and/or pivot with respect to the end of the conduit 110, thereby allowing the keyboard brush 106*a* to accommodate variations in the surface of a keyboard 200** and/or the ergonomics of the keyboard or user.

As shown, keyboard brush **106*a* is provided having a rectangular spine member 116 coupled to the second end of conduit 104. In some examples, one or both of the ends of spine member 116 (e.g., the front and back ends) are provided in the form of an upturned lip to inhibit damaging of the keyboard during use. For example, providing the spine member with upturned ends may prevent the keyboard brush 106*a* from dragging across surfaces of the keyboard 200. In some implementations, spine member 116 may be provided having a length "l" approximately equal to the length of two or more single size keyboard keys. For example, in this implementation, the length "l" of spine member 116 is equal to the length of about four single size keyboard keys. In accordance with the present disclosure, a single size keyboard key may be considered an 18×18 mm keyboard key (e.g., keyboard key 202***a* of FIG. 1) and a double size keyboard key may be considered a 36×18 mm keyboard key (e.g., keyboard key 202*b* of FIG. 1). An underside of spine member 116 carries bristles 118. In some implementations, bristles 118 are substantially anti-static to inhibit static discharge damage to any nearby electrical systems (e.g., computer systems).

The spine member 116 may cooperate with an orifice 120 of conduit 104 such that the conduit 104 is in fluid communication with the underside of the keyboard brush 106*a*. For example, in this implementation, the spine member 116 includes an opening cooperating with orifice 120. In some examples, the opening of spine member 116 is at least as large as orifice 120. In some implementations, the spine member opening is provided having a suitable size and/or shape such as to inhibit or prevent a keyboard key from being drawn into orifice 120. For example, the opening of spine member 116 can be smaller than a single size keyboard key in at least one dimension (e.g., length or width).

Figure 3:
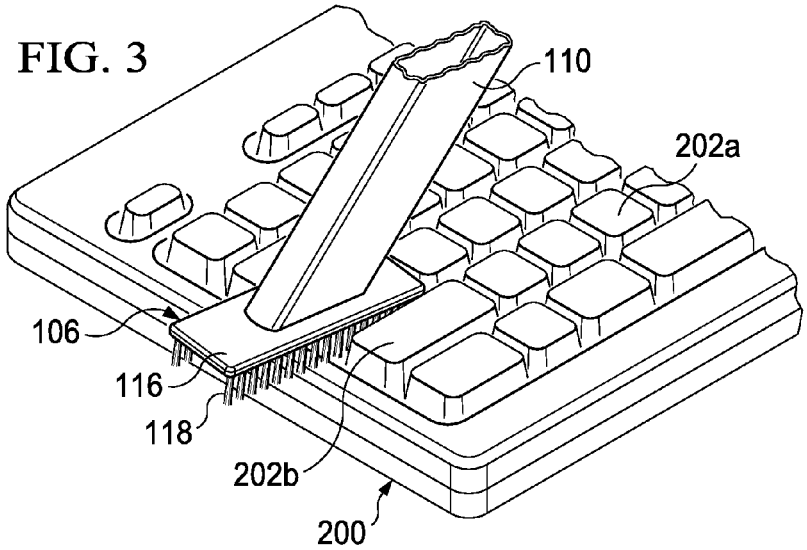
Figure 4:
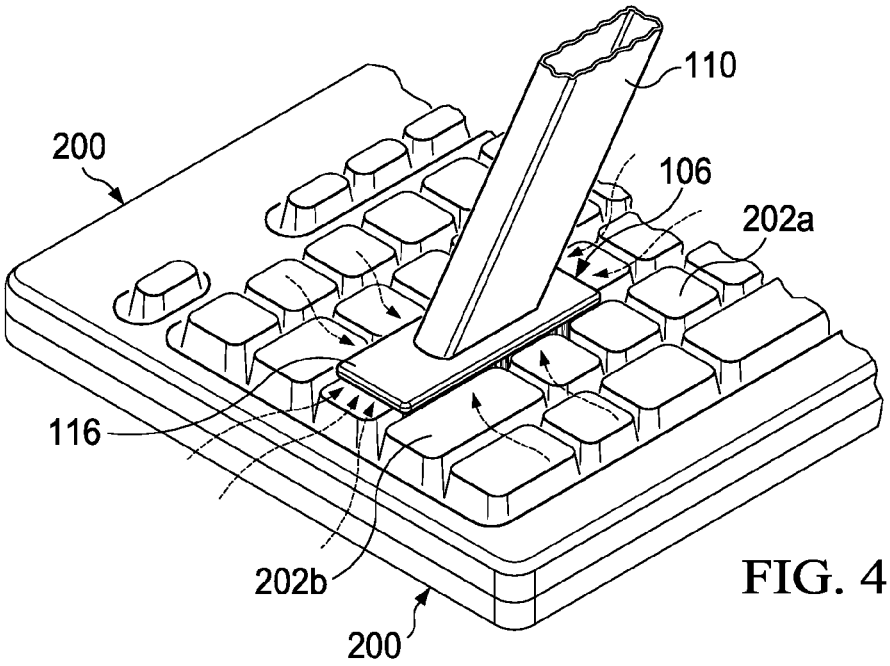

As shown, orifice 120 is provided with an elongated shape stretching lengthwise across spine member 116. It may be advantageous to provide an elongated orifice 120 having a length greater than a single size keyboard key in order to concentrate the suction provided by the vacuum assembly across a wide area (including the areas between keyboard keys 202). Bristles 118 may be fixedly coupled to spine member 116 in a selected configuration. For example, bristles 118 can be arranged in groups of bristles. In this implementation, bristles 118 are arranged in groups along the length of the spine member 116 in two parallel rows bracketing conduit orifice 120. In some examples, the distance "d" between the two rows of bristles 118 may be slightly larger than the width of a single row of standard keyboard keys 202. As such, during use, bristles 118 can be pressed into the space between adjacent rows of keyboard keys (as shown in FIGS. 3-4). In some implementations, the suction provided by the vacuum assembly is sufficient to pull bristles 118 against the side surfaces of keyboard keys 202, thereby facilitating debris removal from the keys 202 by the contacting engagement of the bristles 118. In some other examples, the distance "d" is slightly larger than the width of two or more rows of keyboard keys 202 such that the keyboard brush may be applied to multiple rows of keyboard keys 202 simultaneously. In still some other examples, spine member 116 carries bristles arranged in three or more parallel rows such that the keyboard brush may be applied to multiple rows of keyboard keys 202 simultaneously.

Figure 6:
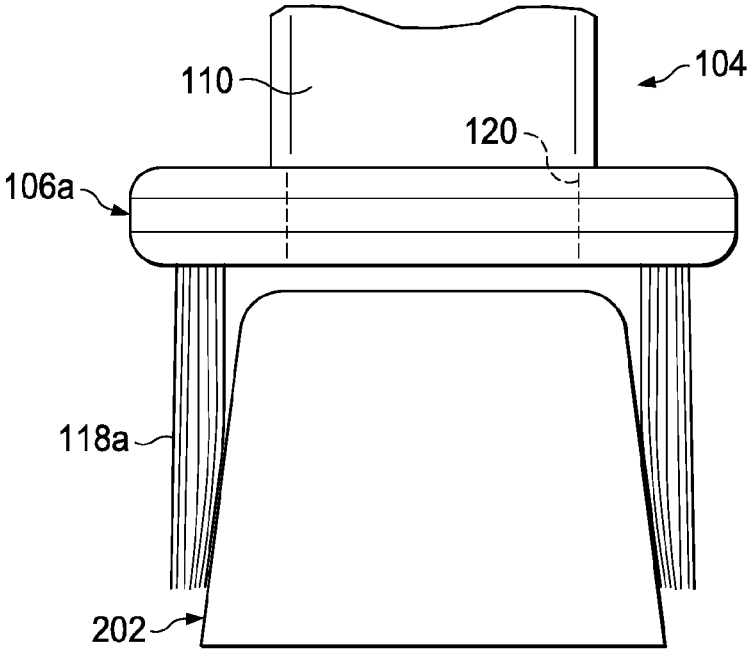
FIG. 6 illustrates one implementation of a brush for cleaning computer peripherals provided with tapered bristles in accordance with the present disclosure.
Figure 5:
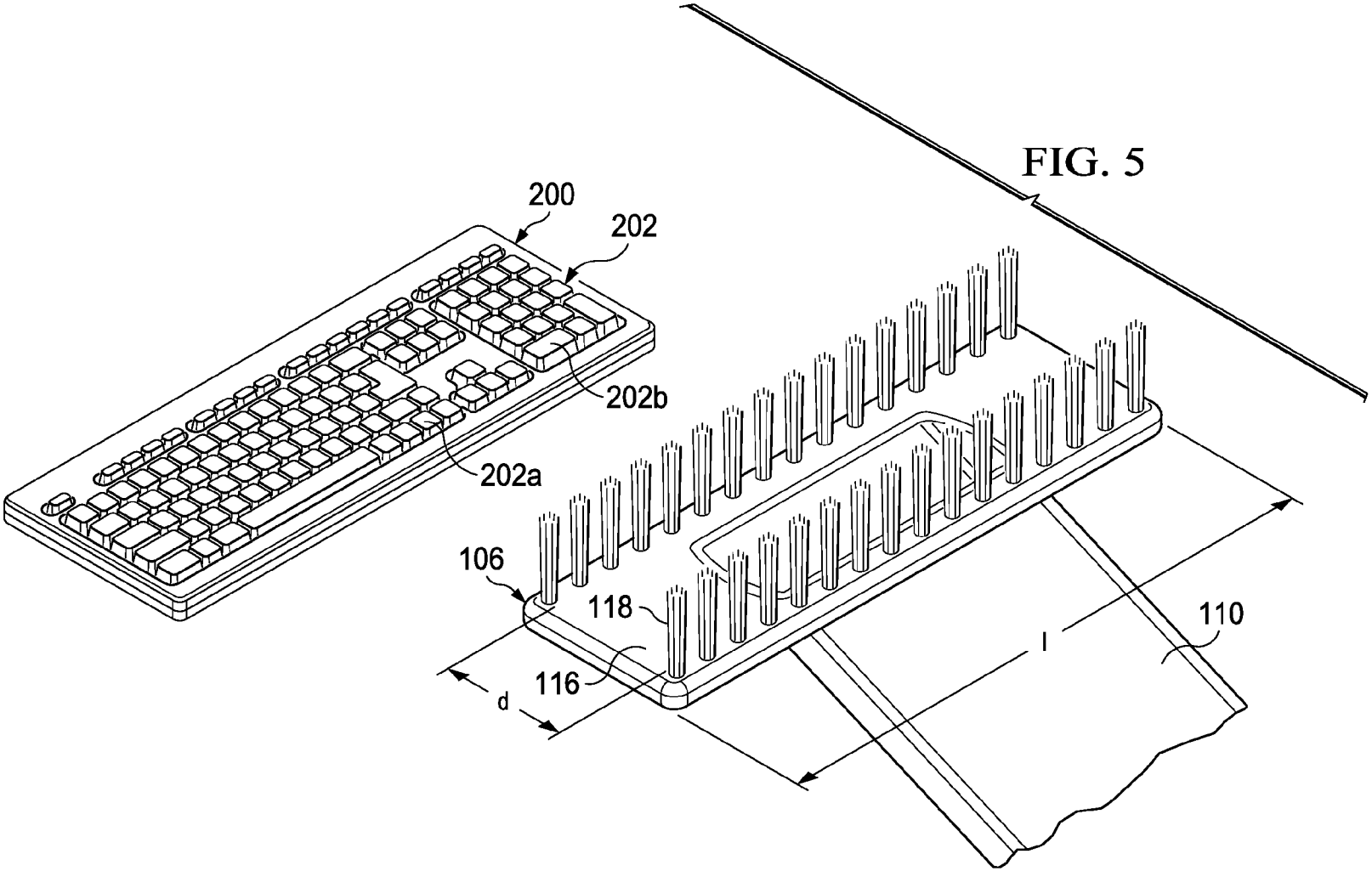

The height of bristles 118 may be sufficient to extend to the keyboard floor beneath keyboard keys 202 in order to loosen any trapped debris. Additionally, bristles 118 may be provided with a sufficient stiffness to scrape against the keyboard surfaces (e.g., the surfaces of keyboard keys 202 and/or the keyboard floor) and agitate and/or loosen any trapped or wedged debris. In some implementations, the fibers of bristles 118 are provided in different lengths to form bristles that are contoured to the shape of the keyboard keys. For example, FIG. 6 illustrates contoured bristles 118*a* contacting along two side surfaces of a single size keyboard key 202*a*.

FIGS. 2-4 and 6 illustrate an example embodiment of keyboard brush 106*a* that may be configured to envelope at least one set of multiple adjacent single size keyboard keys 202*a* (i.e., keyboard keys in one or more rows). In this example, keyboard brush 106*a* may be applied to a set of keyboard keys 202 such that bristles 118 are pressed against the side surfaces of keys 202 and reach down to the keyboard floor. Orifice 120 may be positioned just above a top surface of the keys. As shown, spine member 116 may form a seal near the top of the keys inhibiting inward fluid flow from above the keyboard 200 and thereby at least partially forcing a vacuum region provided above the keys (i.e., a vacuum region provided at conduit orifice 120 via vacuum assembly 102) to an area near the base of the keys (e.g., the keyboard floor). As such, all or most of the fluid drawn into the conduit orifice is pulled through bristles 118 from the keyboard floor. In some examples, groups of bristles 118 are coupled to spine member 116 such that they are spaced apart from one another. Thus, fluid (e.g., air) can be circulated thorough groups of bristles 118 and the individual bristles themselves. The flow lines in FIG. 4 illustrate that the small perforated airspace created by the keyboard brush 106*a* may cause fluid and loose debris to be drawn into orifice 120 from surrounding areas between keys outside the envelope (e.g., keys in adjacent rows or keys in the same row, ahead or behind the enveloped set of keys).

In some examples, keyboard brush 106*a* can be dragged across the row of keyboard keys to simultaneously loosen embedded or wedged debris using bristles 118 and suck up loosened debris through conduit 104. As keyboard brush 106*a* is dragged, bristles 118 pulled in and out of contact with keyboard keys 202. As a result, pulses of suction are provided near the sides and base of keyboard keys 202.

Figure 7:
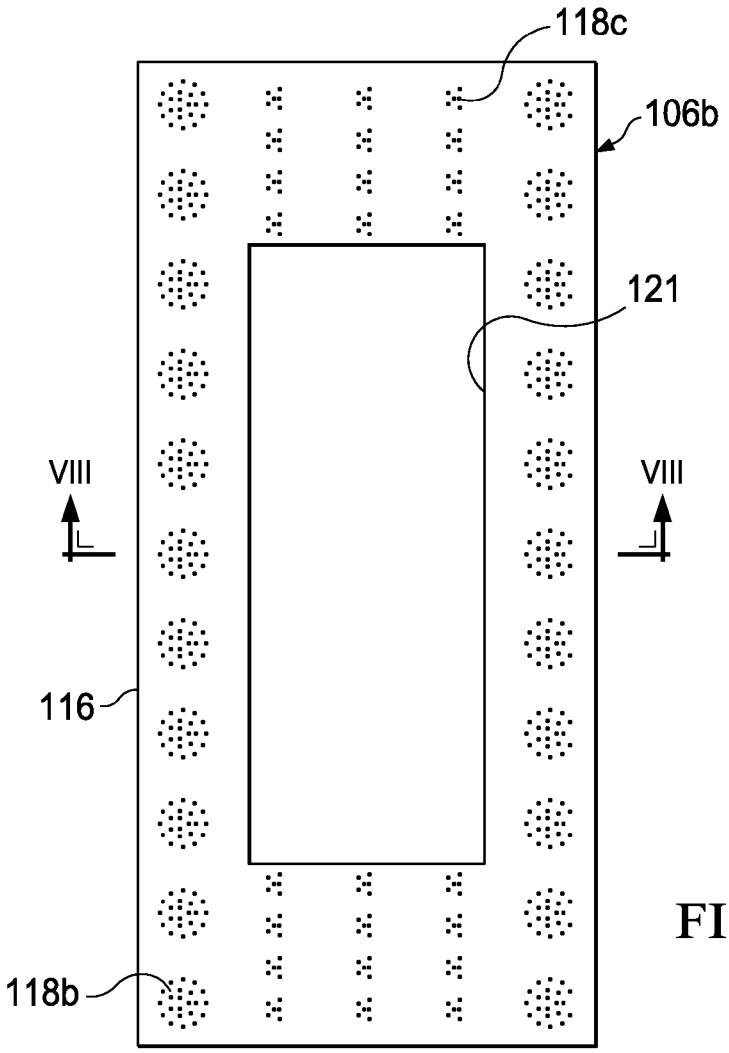
FIGS. 7-8 illustrate one implementation of a brush for cleaning computer peripherals having multiple sets of bristles in accordance with the present disclosure.
Figure 8:
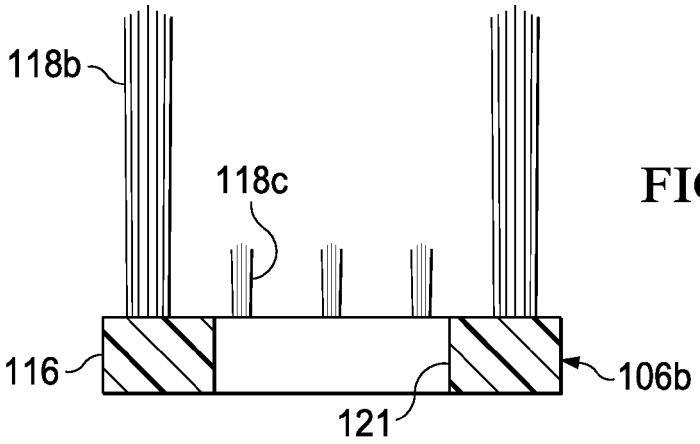

FIGS. 7-8 illustrate a keyboard brush 106*b* in accordance with the present disclosure. In this example, the keyboard brush 106*b* is provided having a spine member 116 carrying a multiplicity of bristles 118 on its underside. The bristles 118 are provided as a first set of bristles 118*b* and a second set of bristles 118*c*. Bristles 118*b* are arranged in parallel rows running lengthwise along the outer edges of spine member 116. Bristles 118*c* are arranged in parallel rows running lengthwise along an inner portion of spine member 116. As shown in FIG. 8, the average length of bristles 118*b* is greater than the average length of bristles 118*c*. When keyboard brush 106*b* is applied to a set of adjacent keyboard keys 202, bristles 118*b* are pressed against the side surfaces of the keys and the keyboard floor while bristles 118*c* are pressed against the top surfaces of the keys. As such, when the keyboard brush traverses the keys 202, bristles 118*b* agitate and/or loosen debris on the key side surfaces and the keyboard floor while bristles 118*c* agitate and/or loosen debris on the tops of the keys. The debris is then forcibly drawn through an opening 121 of the spine member (opening 121 may be in cooperation with an orifice of conduit 104 or may lead directly to a housing of vacuum assembly 102) and eventually into a debris container.

Figure 9:
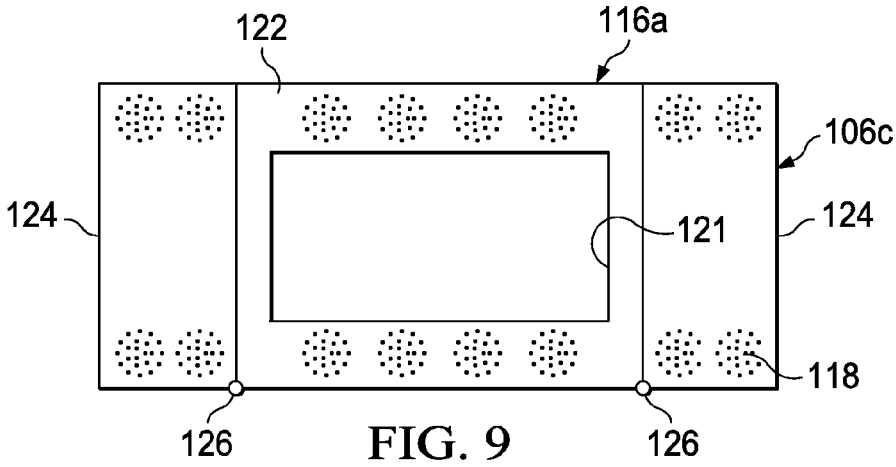
FIGS. 9-11 illustrate one implementation of a brush for cleaning computer peripherals having an articulated spine member in accordance with the present disclosure.
Figure 10:
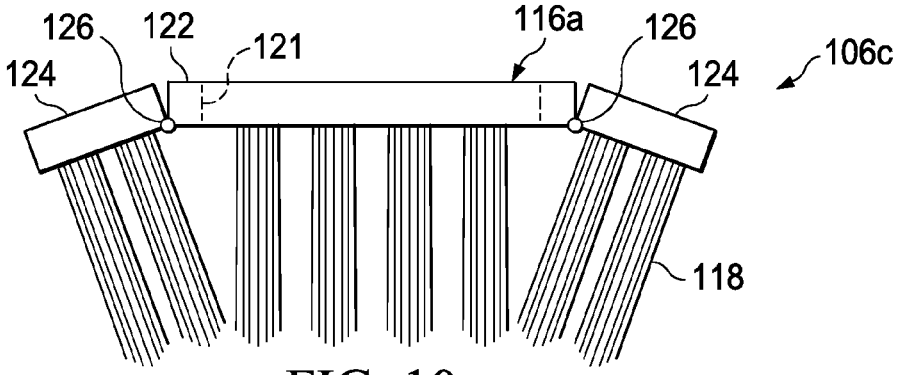
Figure 11:
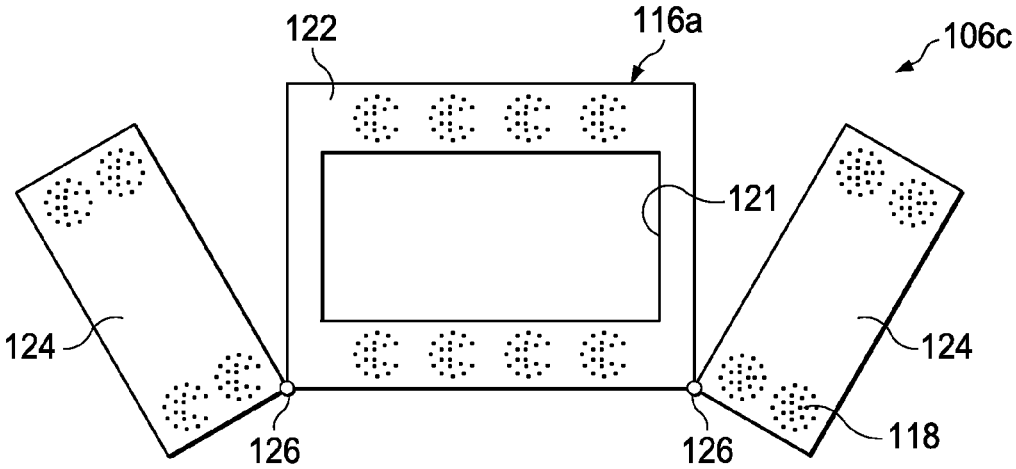

FIGS. 9-11 illustrate an example embodiment of a keyboard brush 106*c* in accordance with the present disclosure. In this example, the keyboard brush 106*c* is provided having an articulated spine member 116*a* carrying a multiplicity of bristles 118 on its underside. As shown, the articulated spine member 116*a* includes a main portion 122 and two outer portions 124. The outer portions 124 are coupled to the main portion 122 by flexible joints 126. As shown, the flexible joints 126 allow outer portions 124 to pivot inward and outward from main portion 122 in various directions. For example, it may be advantageous to provide an articulated spine member 116*a* for cleaning ergonomic keyboards having curved and uneven rows of keyboard keys.

Figure 12:
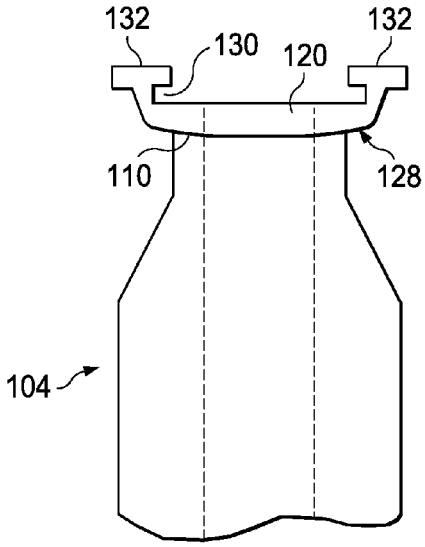
FIGS. 12-14 illustrate one implementation of a computer peripheral cleaner having a removable brush.
Figure 13:
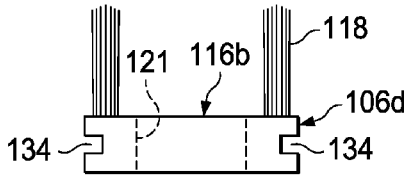
Figure 14:
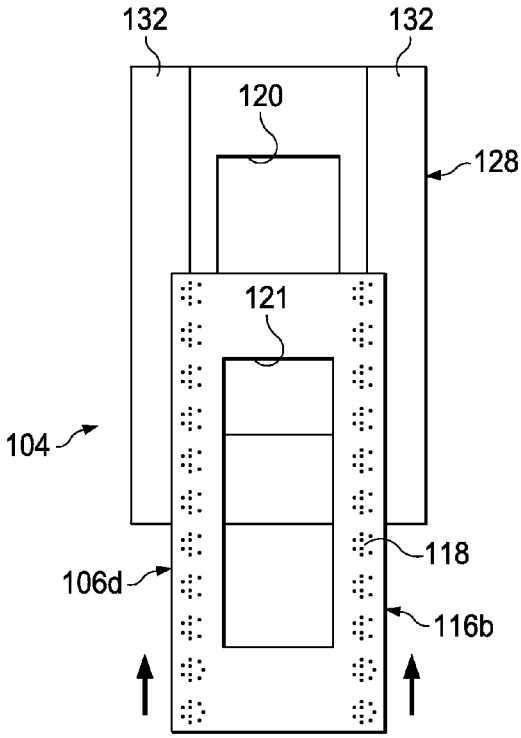

FIGS. 12-14 illustrate an example embodiment of a keyboard cleaner 100*a* in accordance with the present disclosure (for clarity only a portion of the keyboard cleaner is shown). In this example, keyboard cleaner 100*a* includes a vacuum assembly (not shown), a conduit 104 having a first end coupled to the vacuum assembly, and a brush 106*d* that can be detachably coupled to a second end 110 of the conduit. As shown in FIG. 12, the second end of conduit 104 is provided in the form of a bracket 128 defining an opening 130 for receiving a portion of keyboard brush 106*d* and parallel flanges 132 for supporting the keyboard brush 106*d*.

As shown in FIG. 13, keyboard brush 106*d* includes a spine member 116*b* defining parallel slots 134 and opening 121. The spine member carries bristles 118 on its underside. As shown in FIG. 14, keyboard brush 106*d* can be releasably coupled to conduit 104 by connecting the spine member 116*b* to bracket 128. In this example, the spine member 116*b* can be connected to the bracket 128 by aligning spine slots 134 with bracket flanges 132 and sliding the spine member 116*b* laterally along the bracket 128 until the spine member opening 121 is aligned with a conduit orifice 120. In some other examples, the spine member 166*b* can be connected to the bracket 128 by pressing the bracket flanges 132 into the spine slots 134 (i.e., snap fitting). In some further implementations, various other quick coupling configurations are used to detachably couple keyboard brush 106*d* to another portion of cleaner 100*a* (e.g., conduit 104, as shown, or vacuum assembly 102).

Figure 15:
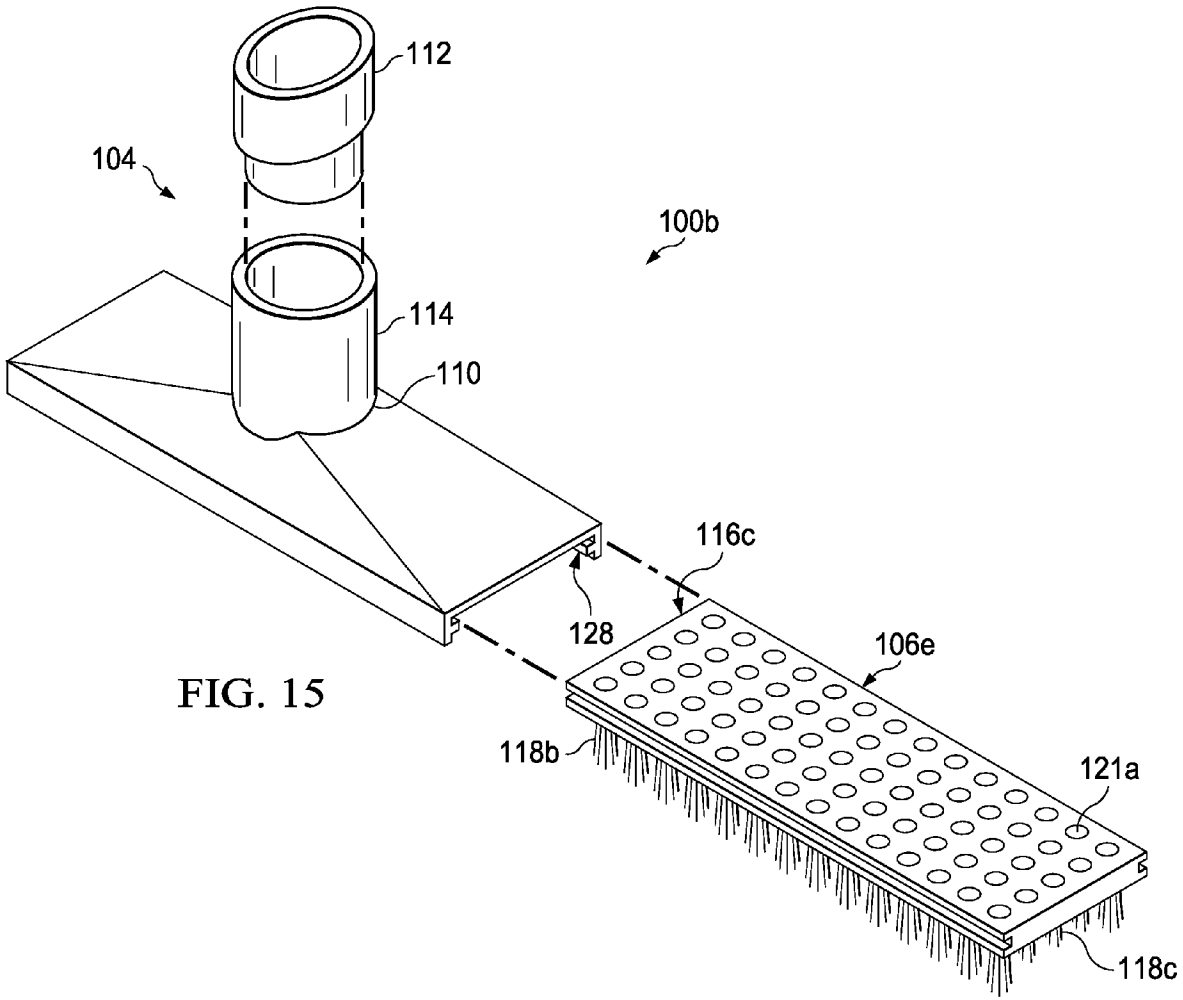
FIG. 15 illustrates one implementation of a computer peripheral cleaner including a brush provided with a plurality of openings.

FIG. 15 illustrates an example embodiment of a keyboard cleaner 100*b* in accordance with the present disclosure (for clarity only a portion of the keyboard cleaner is shown). In this example, keyboard cleaner 100*b* includes a vacuum assembly (not shown), a conduit 104 having a first end coupled to the vacuum assembly, and a brush 106*e* that can be detachably coupled to a second end 110 of the conduit 104. As shown, the second end 110 of conduit 104 is provided with a bracket 128 and the keyboard brush 106*e* includes a spine member 116*c* that can be received by the bracket.

In this example, spine member 116*c* is provided having a plurality of openings 121*a* arranged in a selected configuration and extending from the top side of the spine member to its underside. As shown, the openings 121*a* are arranged in parallel rows forming a grid-like pattern distributed between bristles 118*b* and 118*c* which are carried by the spine member 116*c*. In some examples, bristles 118*b* and 118*c* extend across the length of spine member 116*c* forming a grid like pattern of bristles interlaced with the pattern of openings 121*a*. As shown, the average length of bristles 118*b* is greater than the average length of bristles 118*c*. When keyboard brush 106*e* is coupled to second conduit end 110, openings 121*a* may be in fluid communication with an orifice 120 of conduit 104. As such, fluid and loose debris may be forcibly drawn in through openings 121*a* and subsequently received by conduit orifice 120.

A number of implementations have been described. Nevertheless, it will be understood that various modifications may be made. For example, while some embodiments have been described and/or illustrated in terms of cleaning keyboards, other computer components or computer peripherals may be cleaned according to the disclosed techniques and apparatus. In addition, several methods may be performed with or by the disclosed apparatus. Accordingly, other implementations are within the scope of the present disclosure.

What is claimed is:

1. A keyboard cleaning apparatus, comprising:

a conduit comprising a low pressure region and configured to receive an airflow directed from a high pressure region towards the low pressure region;

a frame attached to the conduit and comprising an orifice that comprises an orifice center substantially aligned with a center of the frame and an orifice perimeter that is bounded on each side of the orifice by the frame, the orifice configured to direct the airflow to the conduit; and a plurality of bristles attached to the frame proximate two sides of the orifice perimeter and defining the high pressure region near the orifice, a first portion of the plurality of bristles contactingly engage a first oblique surface of a key of a keyboard and urge debris proximate the first oblique surface into the airflow, a second portion of the plurality of the bristles contactingly engage a second oblique surface of the key of the keyboard and urge debris proximate the second oblique surface into the airflow, at least some of the plurality of bristles contactingly engage a floor of the keyboard and urge debris proximate the floor into the airflow.

2. The cleaning apparatus of claim 1, wherein the plurality of bristles are arranged in substantially parallel rows adjacent perimeter sides of the frame.

3. The cleaning apparatus of claim 1, wherein the plurality of bristles are arranged in a plurality of groups of bristles, and wherein a particular group of bristles comprises a first set of bristles and a second set of bristles.

4. The cleaning apparatus of claim 3, wherein the first set of bristles are a first length and the second set of bristles are a second length greater than the first length, and wherein the first set of bristles are attached to the frame closer to a lengthwise centerline of the frame relative to the second set of bristles.

5. The cleaning apparatus of claim 4, wherein the second length is substantially equal to a distance between a floor of the keyboard and a top surface of the key.

6. The cleaning apparatus of claim 1, wherein the bristles configured to contactingly engage a floor of the keyboard comprise tips operable to agitate debris proximate the floor; and wherein the bristles configured to contactingly engage the first or second oblique surfaces comprise elongated stalks operable to agitate debris proximate the first or second oblique surfaces.

7. The cleaning apparatus of claim 1, wherein the frame comprises a substantially rectangular perimeter, and wherein lengths of the lengthwise sides of the frame are one of approximately 36 mm, approximately 54 mm, or approximately 72 mm.

8. The cleaning apparatus of claim 1, wherein the frame and the plurality of bristles define a fluid pathway between a floor of the keyboard and the orifice in which the airflow is substantially constrained.

9. The cleaning apparatus of claim 1, wherein the frame comprises an articulated frame having a first frame section and a second frame section, the first frame section hingedly connected to the second frame section and configured to angularly displace apart from the second frame section.

10. The cleaning apparatus of claim 9, wherein the first frame section is configured to angularly displace apart from the second frame section about an axis substantially parallel to the groups of bristles.

11. The cleaning apparatus of claim 1, further comprising a second plurality of bristles attached to the frame proximate another two sides of the orifice perimeter.

12. The cleaning apparatus of claim 11, wherein a first portion of the second plurality of bristles is configured to contactingly engage a third oblique surface of the key of the keyboard and urge debris proximate the third oblique surface into the airflow.

13. The cleaning apparatus of claim 12, wherein the first portion of the second plurality of bristles is shorter than the plurality of bristles attached to the frame proximate the two sides of the orifice perimeter.

14. The cleaning apparatus of claim 1, wherein the orifice is the only orifice configured to direct the airflow to the conduit.

15. A keyboard cleaning system, comprising:

a vacuum assembly configured to generate a low pressure region near an inlet of the vacuum assembly; and a brush assembly, comprising:

a conduit coupled to the inlet of the vacuum assembly and configured to receive an airflow directed from a high pressure region towards the low pressure region;

a frame attached to the conduit and comprising an orifice that comprises an orifice center substantially aligned with a center of the frame and an orifice perimeter that is bounded on each side of the orifice by the frame, the orifice configured to direct the airflow to the conduit; and a plurality of bristles attached to the frame proximate the orifice and defining the high pressure region near the orifice, a first portion of the plurality of bristles contactingly engage a first oblique surface of a key of a keyboard and urge debris proximate the first oblique surface into the airflow, a second portion of the plurality of the bristles contactingly engage a second oblique surface of the key of the keyboard and urge debris proximate the second oblique surface into the airflow, at least some of the bristles are contactingly engage a floor of the keyboard and urge debris proximate the floor into the airflow.

16. The cleaning system of claim 15, wherein the plurality of bristles are arranged in substantially parallel rows adjacent perimeter sides of the frame.

17. The cleaning system of claim 15, wherein the plurality of bristles are arranged in a plurality of groups of bristles, and wherein a particular group of bristles comprises a first set of bristles and a second set of bristles.

18. The cleaning system of claim 17, wherein the first set of bristles are a first length and the second set of bristles are a second length greater than the first length, and wherein the first set of bristles are attached to the frame closer to a lengthwise centerline of the frame relative to the second set of bristles.

19. The cleaning system of claim 18, wherein the second length is substantially equal to a distance between a floor of the keyboard and a top surface of the key.

20. The cleaning system of claim 15, wherein the bristles configured to contactingly engage a floor of the keyboard comprise tips operable to agitate debris proximate the floor; and wherein the bristles configured to contactingly engage the first or second oblique surfaces comprise elongated stalks operable to agitate debris proximate the first or second oblique surfaces.

21. The cleaning system of claim 15, wherein the vacuum assembly comprises a debris container configured to store the debris delivered to the vacuum assembly in the airflow through the conduit.

22. A keyboard cleaning apparatus comprising:

a conduit configured to receive an airflow;

a frame attached to the conduit and comprising a single orifice centered in the frame and configured to direct the airflow to the conduit; and a brush attached to the frame and comprising a plurality of bristles arranged in a pattern proximate at least one orifice in the brush, the pattern of bristles defining a passageway in fluid communication with the orifice of the frame, the passageway comprising at least two open ends configured to receive at least a portion of a key of a keyboard, the plurality of bristles comprising a first set of bristles and a second set of bristles, the first set of bristles having a greater height than the second set of bristles, and the first set of bristles are configured to contactingly engage with a first side surface of the keyboard key and the second set of bristles are configured to contactingly engage with a second side surface of the keyboard key different than the first side surface.

23. The keyboard cleaning apparatus of claim 22, wherein the at least one orifice comprises a plurality of orifices, and wherein the plurality of bristles comprises a plurality of groups of bristles, at least one group of bristles surrounding a particular orifice of the plurality of orifices.

24. The keyboard cleaning apparatus of claim 22, wherein a length of the at least one orifice is greater than the length of a single size keyboard key.

25. The keyboard cleaning apparatus of claim 22, wherein the passageway is configured to receive a plurality of single size keyboard keys.

26. The keyboard cleaning apparatus of claim 22, wherein the frame comprises a side surface which defines a slot for attaching the brush to the frame.

27. The keyboard cleaning apparatus of claim 22, wherein the bristles are configured to contactingly engage with side surfaces of a keyboard key.

28. The keyboard cleaning apparatus of claim 22, wherein a length of the bristles is sufficient to reach an area of the keyboard beneath a set of keyboard keys.

29. A keyboard cleaning apparatus, comprising:

a conduit comprising a low pressure region and configured to receive an airflow directed from a high pressure region towards the low pressure region;

a frame attached to the conduit and comprising an orifice configured to direct the airflow to the conduit, the frame comprising an articulated frame having a first frame section and a second frame section, the first frame section hingedly connected to the second frame section and configured to angularly displace apart from the second frame section; and a plurality of bristles attached to the frame proximate the orifice and defining the high pressure region near the orifice, a first portion of the plurality of bristles contactingly engage a first oblique surface of a key of a keyboard and urge debris proximate the first oblique surface into the airflow, a second portion of the plurality of the bristles contactingly engage a second oblique surface of the key of the keyboard and urge debris proximate the second oblique surface into the airflow, at least some of the plurality of bristles contactingly engage a floor of the keyboard and urge debris proximate the floor into the airflow.

* * * * *